US007771228B2

(12) United States Patent
Fukaya

(10) Patent No.: US 7,771,228 B2
(45) Date of Patent: Aug. 10, 2010

(54) TERMINAL COVER WITH RESTRICTION

(75) Inventor: Tomoyoshi Fukaya, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/408,756

(22) Filed: Mar. 23, 2009

(65) Prior Publication Data

US 2009/0239412 A1 Sep. 24, 2009

(30) Foreign Application Priority Data

Mar. 21, 2008 (JP) ..... 2008-073796

(51) Int. Cl.
*H01R 13/52* (2006.01)

(52) U.S. Cl. ..... 439/521; 439/522

(58) Field of Classification Search ..... 439/521, 439/522, 901, 674; 174/138 F; 438/202
See application file for complete search history.

(56) References Cited

U.S. PATENT DOCUMENTS

| | | | | |
|---|---|---|---|---|
| 5,413,500 | A | 5/1995 | Tanaka | |
| 5,439,759 | A * | 8/1995 | Lippert et al. | 429/65 |
| 6,533,619 | B2 * | 3/2003 | Wakata et al. | 439/680 |
| 6,705,889 | B2 * | 3/2004 | Nishimoto | 439/521 |

* cited by examiner

*Primary Examiner*—Hae Moon Hyeon
(74) *Attorney, Agent, or Firm*—Gerald E. Hespos; Michael J. Porco

(57) ABSTRACT

A terminal cover has first and second pieces (10, 30) that can be united into a tubular shape. A resilient lock piece (13) is formed on the first piece (10) and engages a lock (41) of the second piece (30) to lock the two pieces (10, 30) in a united state. The first piece (10) is formed with restrictions (17) projecting in a manner to restrict displacements of the first and second pieces (10, 30) in a resilient deforming direction of the resilient lock piece (13) by engaging the second piece (30).

5 Claims, 11 Drawing Sheets

TERMINAL COVER WITH RESTRICTION

BACKGROUND OF THE INVENTION

1. Field of the Invention

The invention relates to a terminal cover.

2. Description of the Related Art

U.S. Pat. No. 5,413,500 discloses a terminal cover for surrounding a terminal fitting by uniting a pair of half pieces coupled by a hinge in a manner to define a tubular shape. A resilient lock piece projects from one half piece and a lock is formed on the other half piece. The resilient lock piece interferes with the lock and resiliently deforms in the process of uniting the half pieces. The resilient lock piece resiliently restores and engages the lock when the half pieces are united properly so that the half pieces are locked in the united state by this engagement action.

The half pieces of the terminal cover may be displaced due to a resilient restoring force of the resilient lock piece in the process of uniting the half pieces. Additionally, the half pieces may be displaced due to an improper deformation of the hinge. As a result, the resilient lock piece may be disengaged from the lock in the united state. Accordingly, a restriction projects from one half piece. The restriction engages the one half piece in the uniting process and in the united state to restrict displacement of the half pieces.

The resilient lock piece and the restriction project from different half pieces in the terminal cover disclosed in U.S. Pat. No. 5,413,500. Accordingly, both half pieces have complicated shapes.

The invention was developed in view of the above situation and an object thereof is to simplify the shapes of half pieces.

SUMMARY OF THE INVENTION

The invention relates to a terminal cover with first and second pieces that are coupled by at least one hinge. The hinge enables the first and second pieces to be united into a substantially tubular shape. At least one resilient lock piece projects from the first piece and is resiliently deformable in a direction intersecting a uniting direction with the second piece. At least one lock is formed on the second piece and is engageable with the lock piece to hold first and second pieces in a united state. At least one restriction projects from the first piece and restricts displacements of the first and second pieces in a resilient deforming direction of the resilient lock piece.

The restriction is formed only on the first piece where the resilient lock piece is formed and need not to be formed on the second piece. Thus, the shape of the second piece is simple as compared with the case where the restriction is formed on the second piece.

The first and second pieces preferably can be united into a substantially tubular shape by deforming the hinge.

The restriction preferably includes at least one groove engageable with the second piece in a manner to fix the second piece in a direction substantially parallel to the resilient deforming direction of the resilient lock piece. As a result, displacements of the first and second pieces are restricted both in the same direction as the resilient deforming direction of the resilient lock piece and in a direction opposite to the resilient deforming direction.

The restriction includes at least one wall projecting from the first piece substantially parallel to the resiliently deforming direction of the resilient lock piece.

The restriction includes a plate-like wall projecting from the first piece substantially parallel to the resiliently deforming direction of the resilient lock piece. As a result, rigidity against external forces acting substantially parallel to the resiliently deforming direction of the resilient lock piece is high. Therefore, displacements of the first and second pieces due to resilient restoring forces of the resilient lock piece are restricted reliably.

Two walls preferably are at the opposite sides of the resilient lock piece to prevent external matter from interfering with the resilient lock piece.

The first piece preferably has a base plate extending substantially in the same direction as the uniting direction with the second piece. The resilient lock piece preferably extends along the outer surface of the base plate from an extending end of the base plate in a direction opposite to an extending direction of the base plate. A frame is formed on the outer surface of the second piece for accommodating the base plate and/or the resilient lock piece. The accommodation of the resilient lock piece in the frame in the united state protects the resilient lock piece from interference of external matter.

A part of the frame preferably serves as the lock. As a result, the shape of the second piece is simplified as compared with the case where the lock is at a position in the second piece different from the frame.

The restriction may project along a lateral edge of the base plate.

The base plate is cantilevered and hence there is a concern that the base plate will be deformed. However, the restriction on the lateral edge of the base plate reinforces the base plate. As a result, the base plate is not likely to be deformed.

Two restrictions preferably project out at substantially opposite sides of the resilient lock piece. The restrictions protect the resilient lock piece from interference of external matter even in a state where the resilient lock piece is at an outer side of the frame without the two pieces being united.

A part of the frame preferably defines an engaging portion engageable with the restriction in the united state. Thus, the shape of the second piece is simplified as compared with the case where the engageable portion is formed at a position other than at the frame in the second piece.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
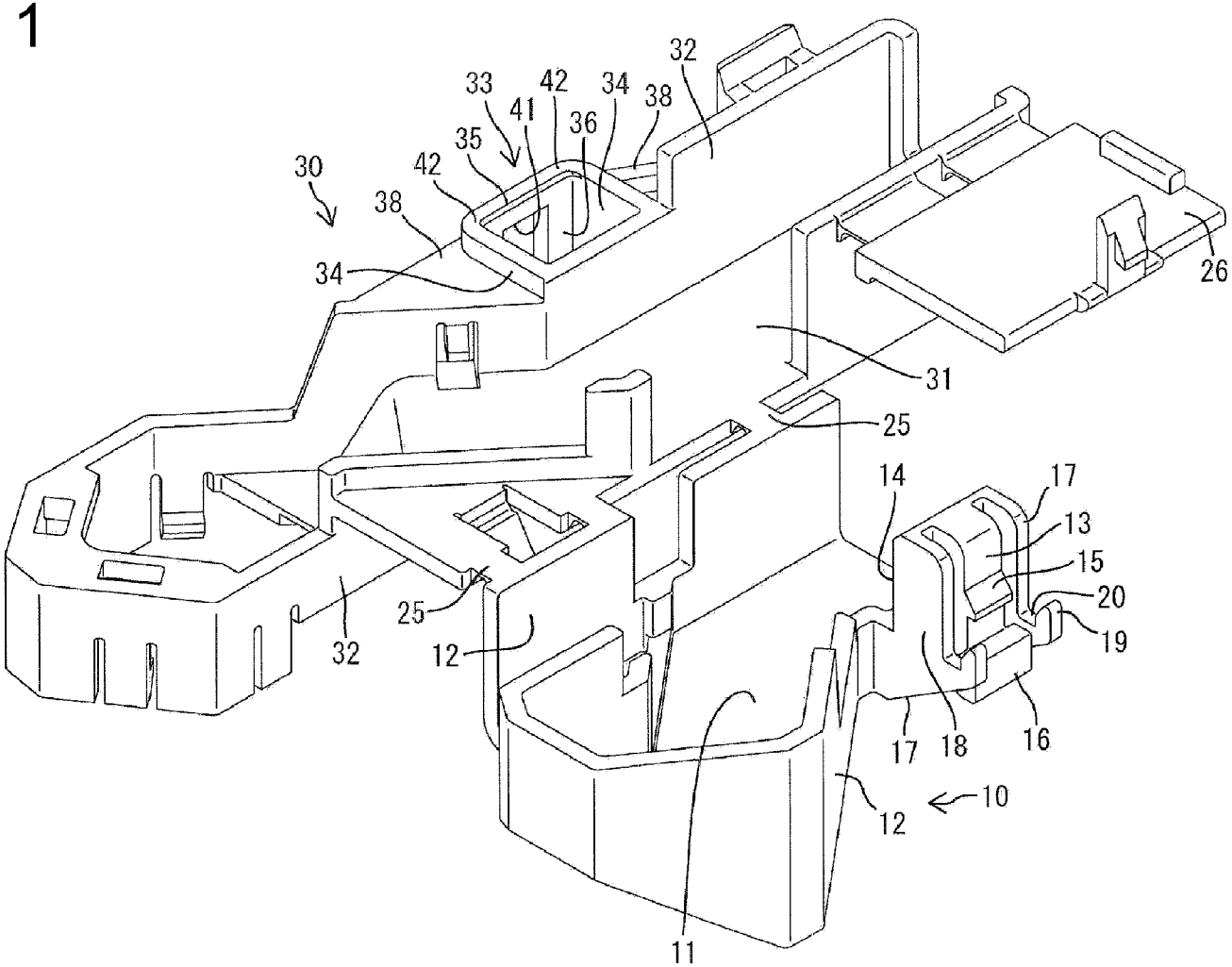
FIG. 1 is a perspective view showing a state where first and second half pieces are not united in one embodiment.
Figure 2:
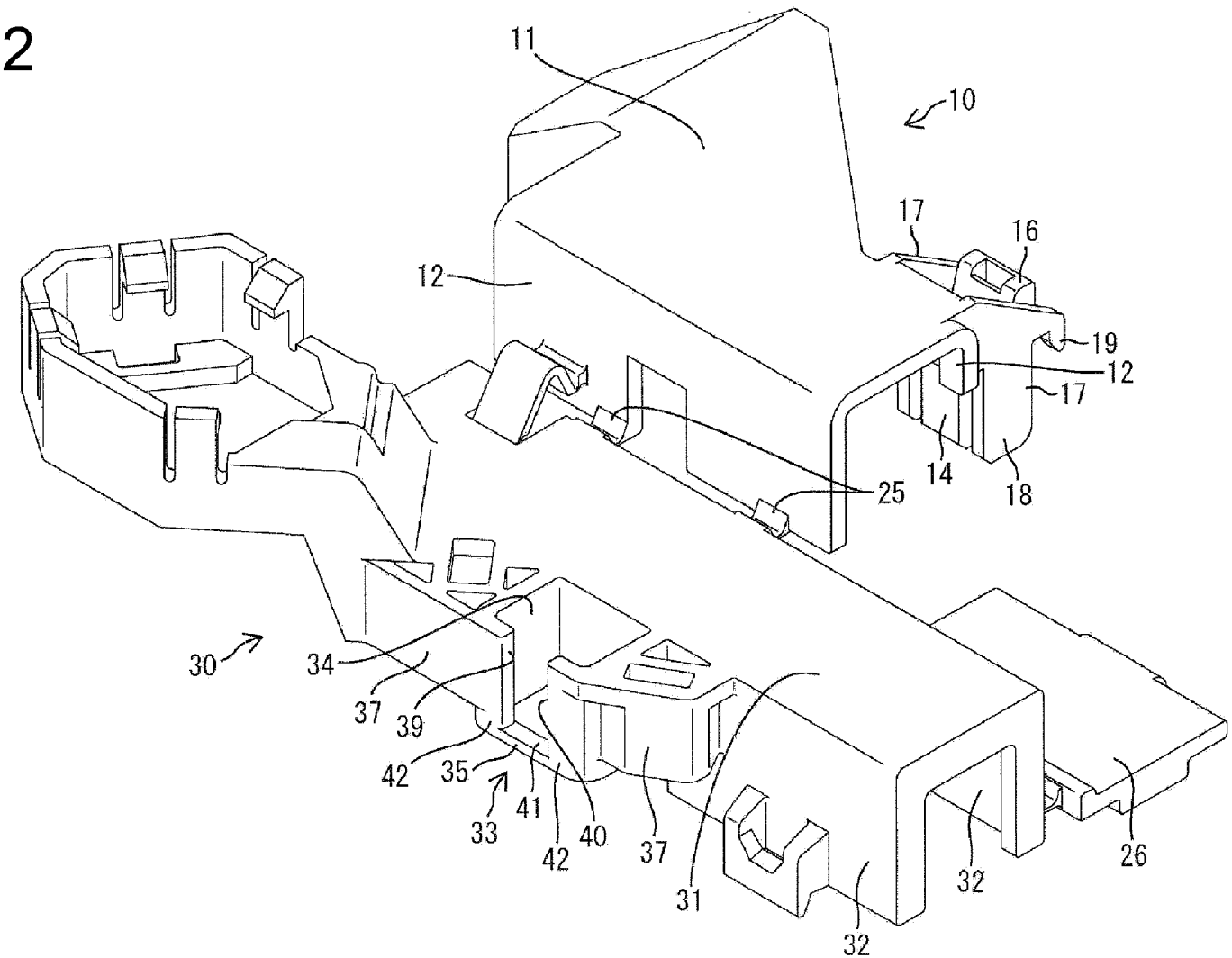
FIG. 2 is a perspective view showing a vertically inverted state of FIG. 1.
Figure 3:
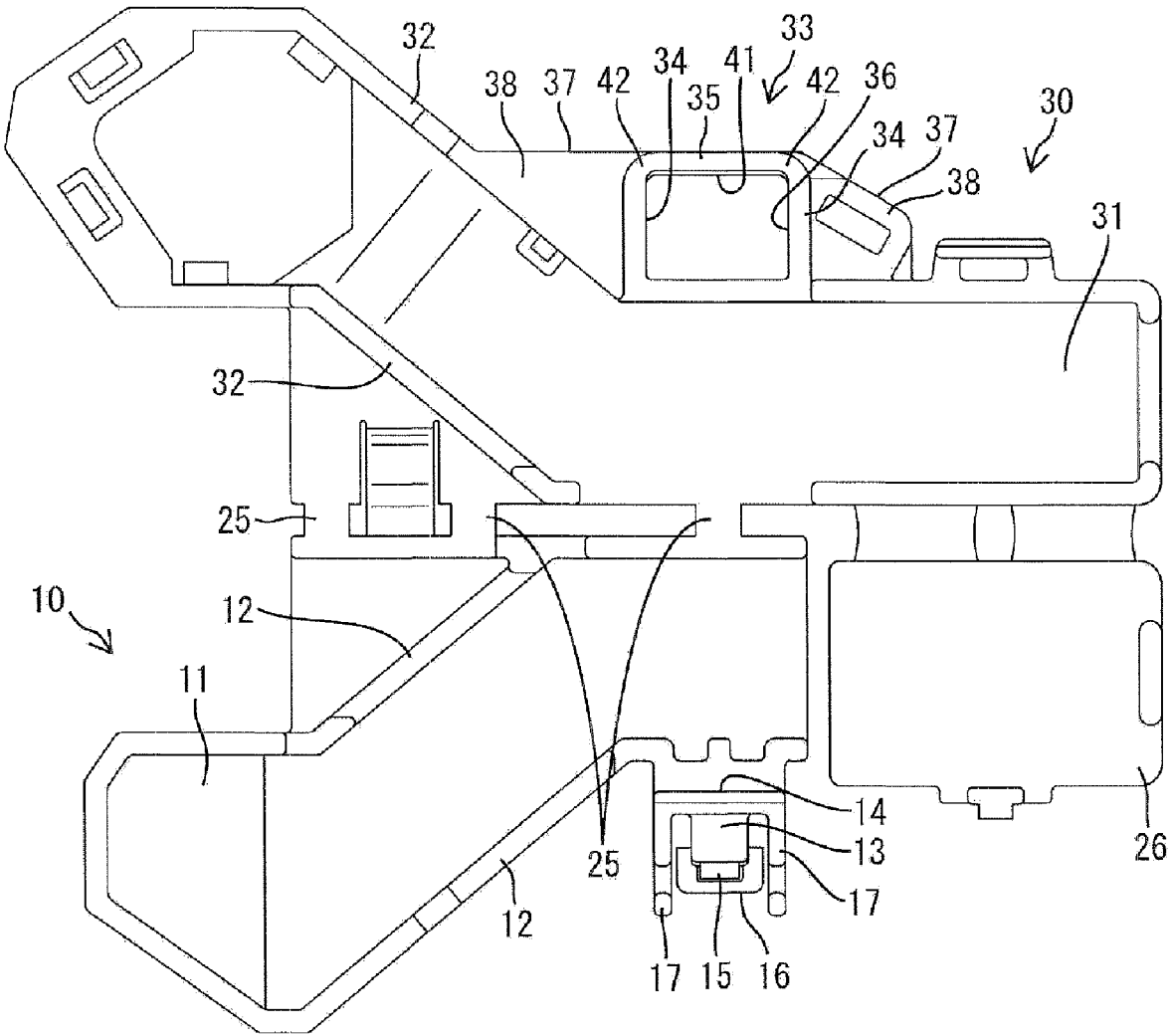
FIG. 3 is a plan view showing the state where the first and second half pieces are not united.
Figure 4:
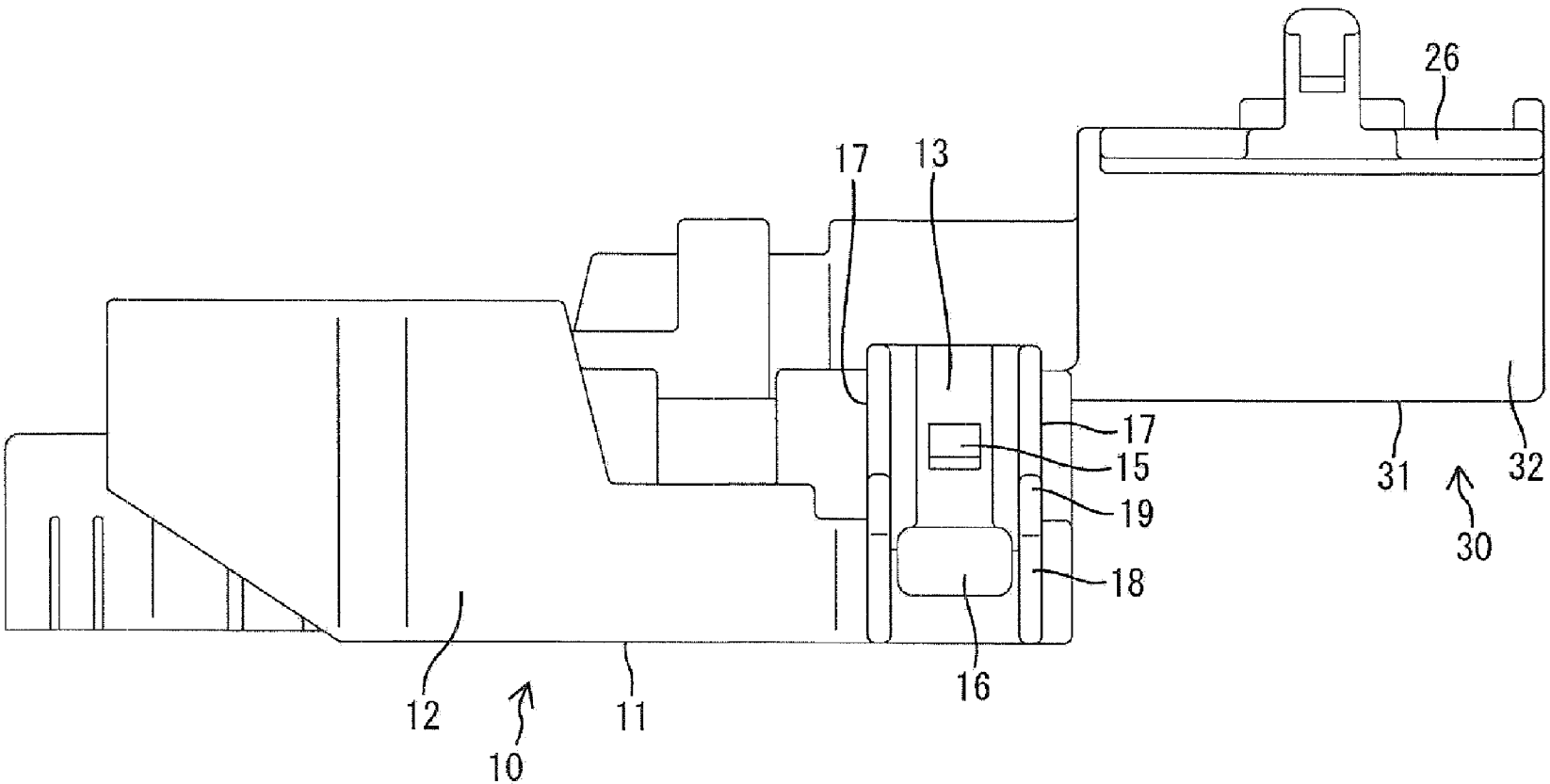
FIG. 4 is a front view showing the state where the first and second half pieces are not united.
Figure 5:
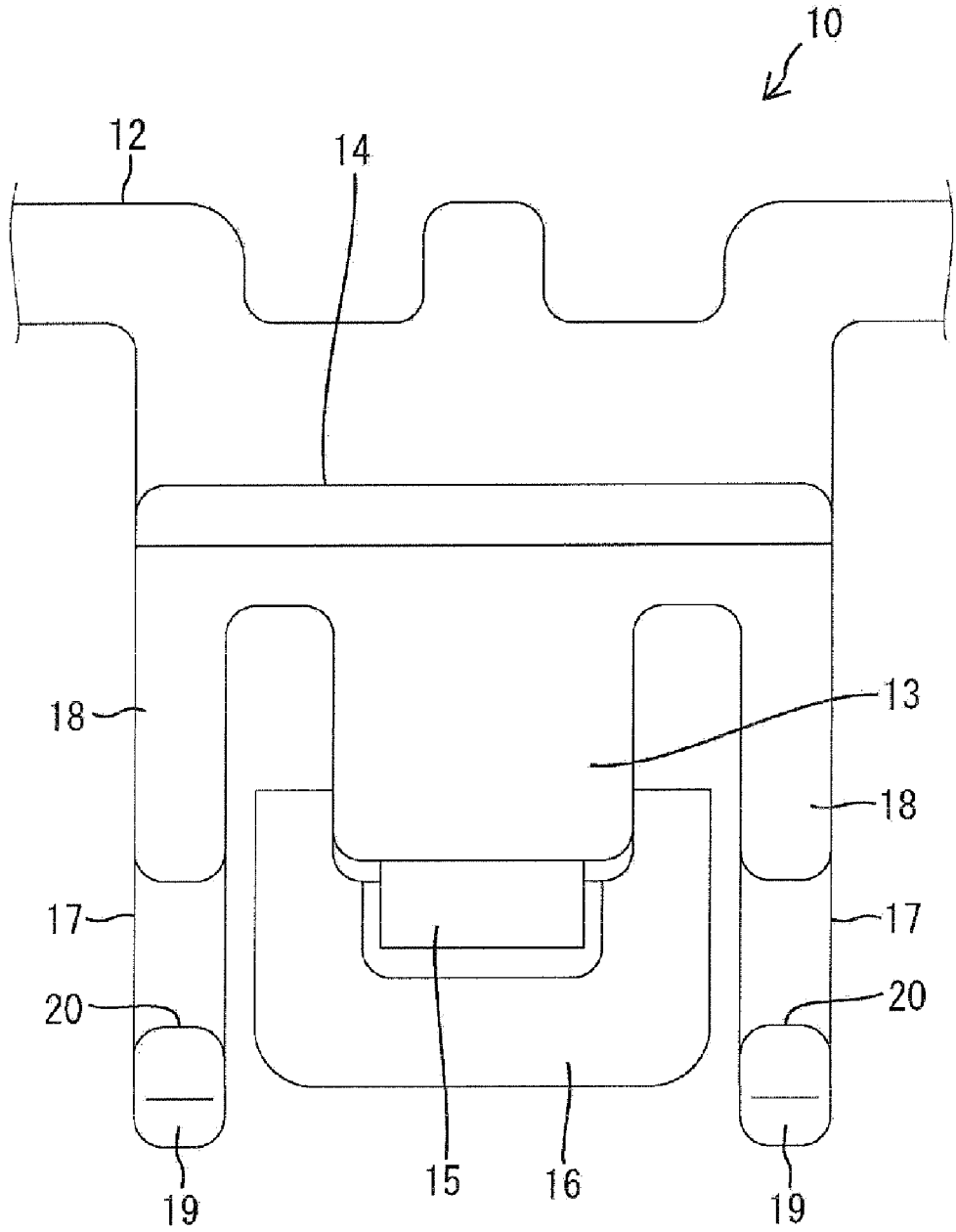
FIG. 5 is a partial enlarged plan view showing a resilient lock piece and restricting portions of FIG. 3.
Figure 6:
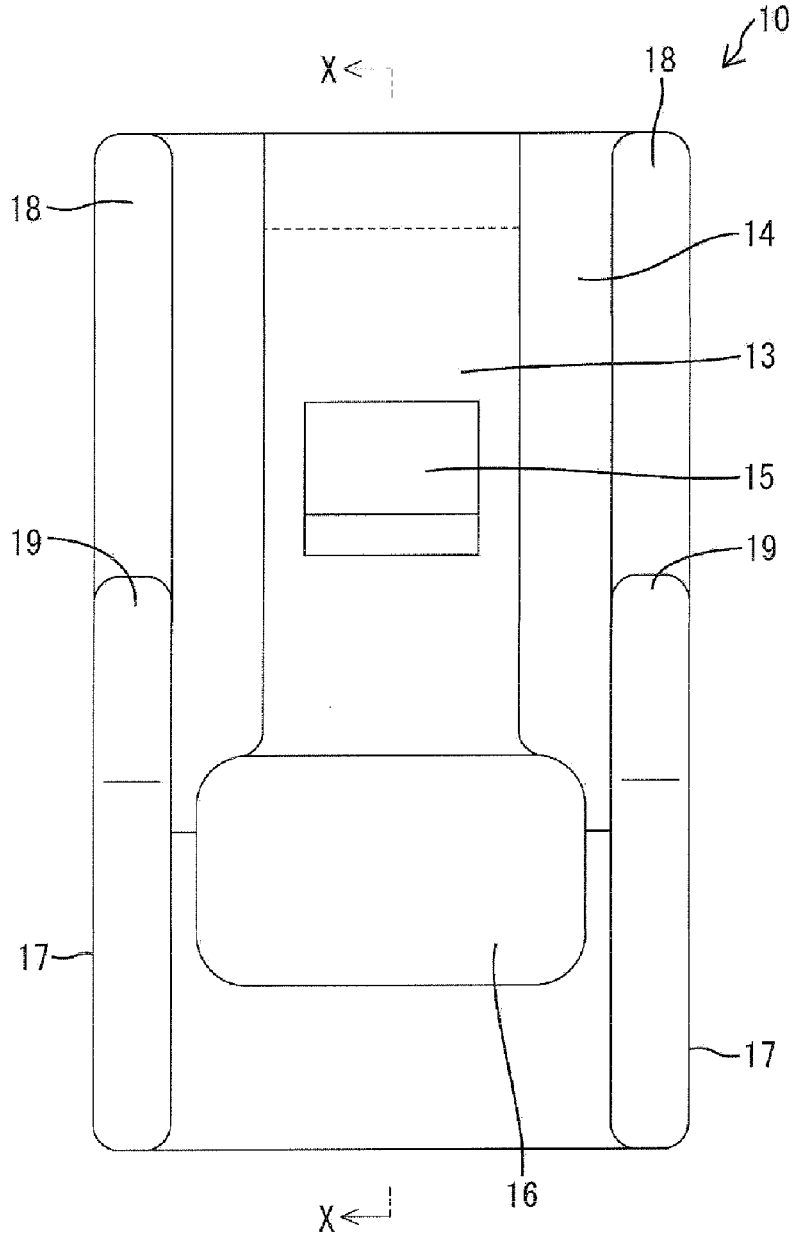
FIG. 6 is a partial enlarged front view showing the resilient lock piece and the restricting portions of FIG. 4.
Figure 7:
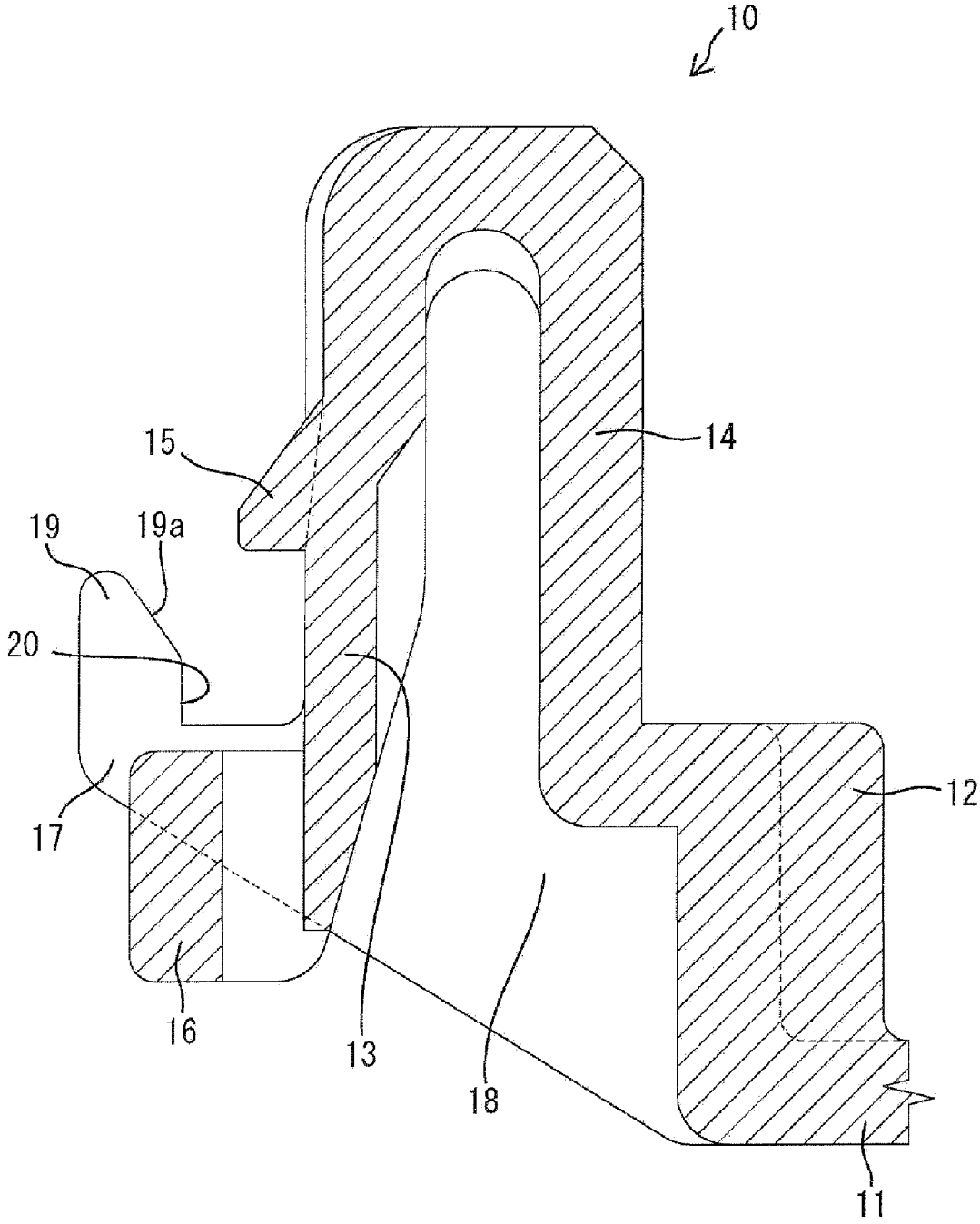
FIG. 7 is a section along X-X of FIG. 6.
Figure 8:
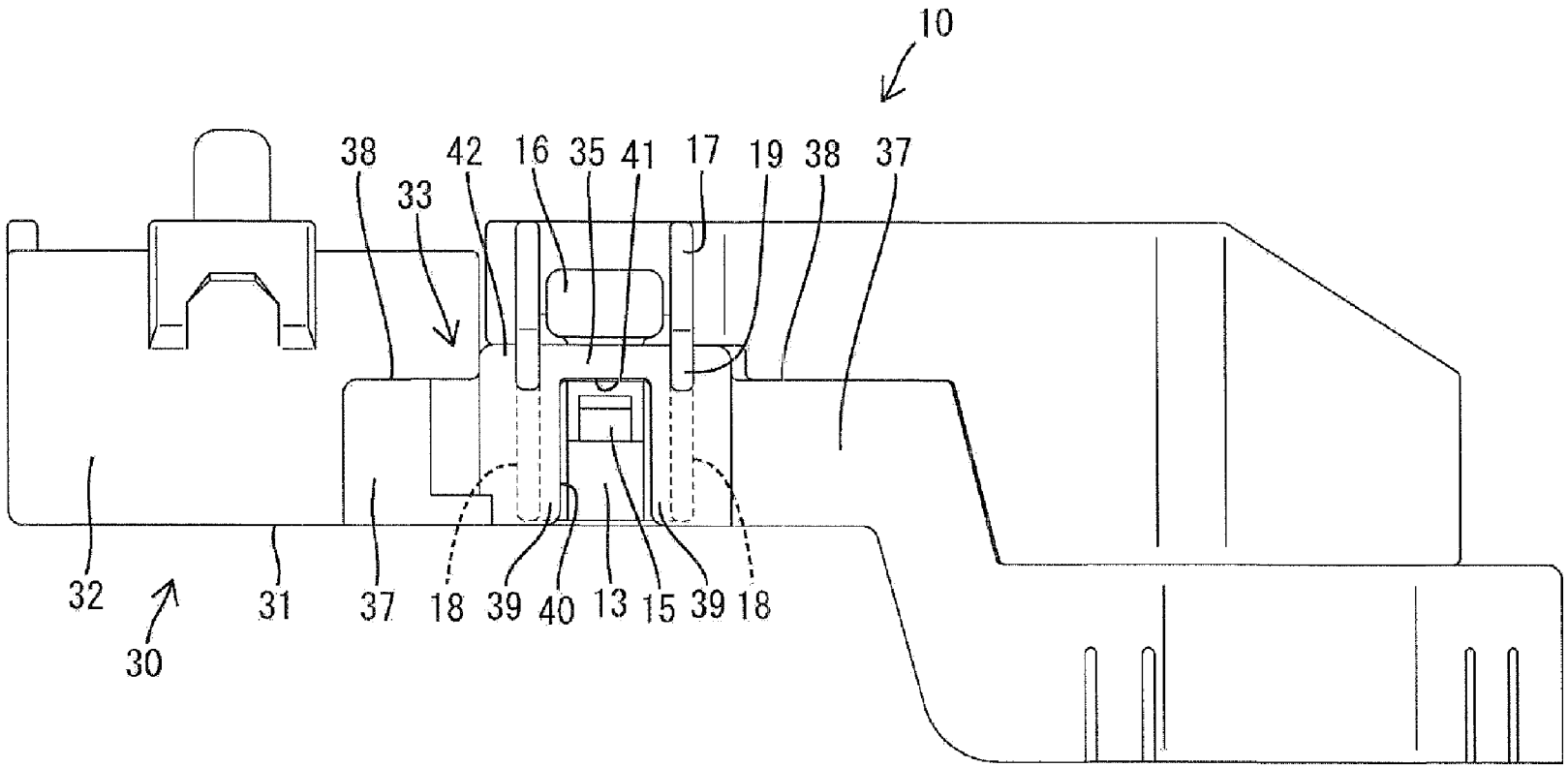
FIG. 8 is a rear view showing a state where the first and second half pieces are united.
Figure 9:
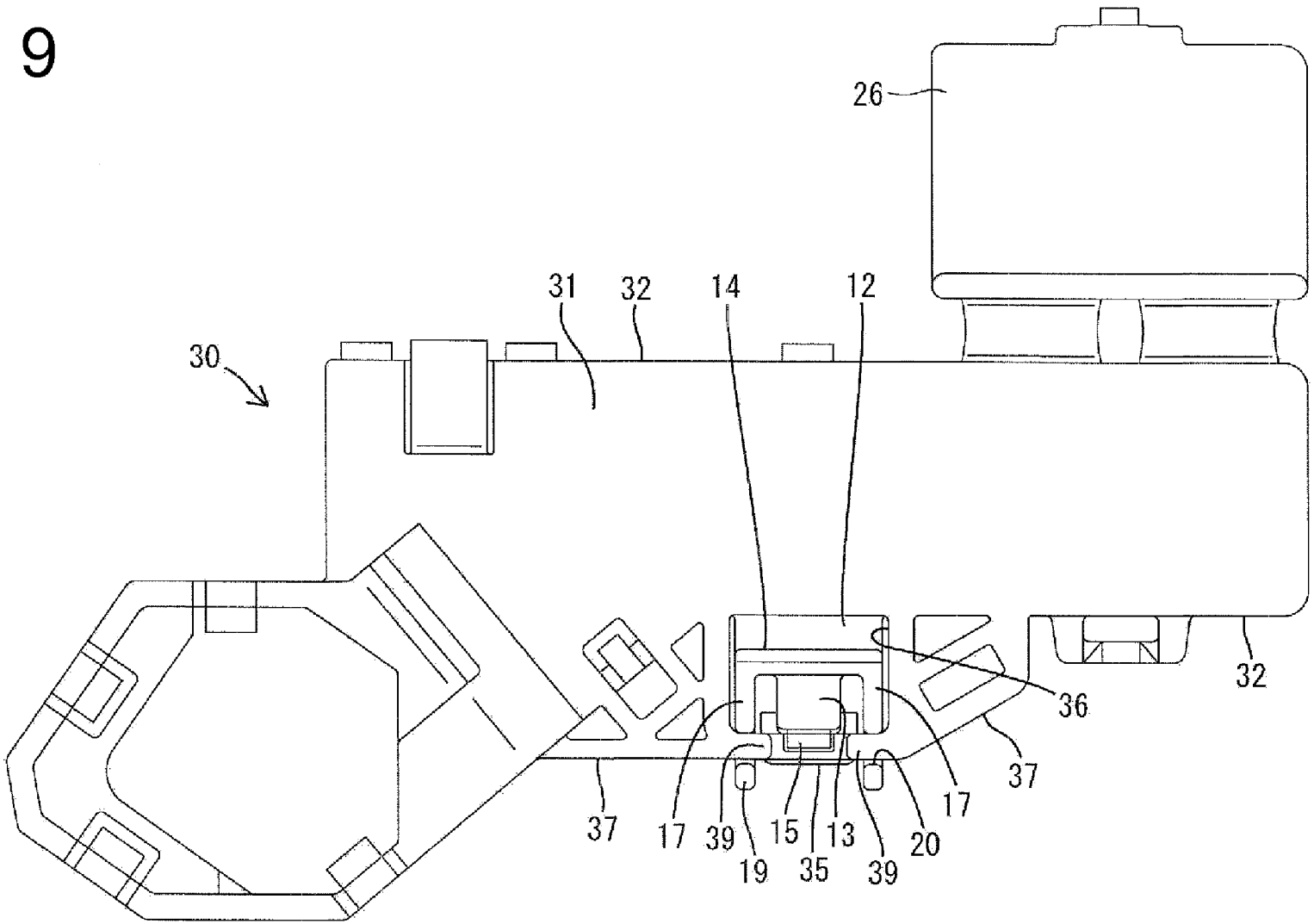
FIG. 9 is a bottom view showing the state where the first and second half pieces are united.

A terminal cover in accordance with the invention is described with reference to FIGS. 1 to 11. The terminal cover is made of resin to define first and second pieces 10 and 30 connected unitarily to on another by a hinge 25. The first and second pieces 10 and 30 can be rotated about the hinge 25 to define a substantially tubular shape. At least one terminal fitting (not shown) connected with at least one wire is accommodated in the tubular cover. A third piece 26 is coupled to the second piece 30 at a position different from the position where the first piece 10 is coupled. The third piece 26 is united with the second piece 30 to form a substantially tubular shape in an area other than the area to be united with the first piece 10.

The first piece 10 includes a first bottom wall 11 and two first side walls 12 that project up from opposite lateral sides of the first bottom wall 11. The hinge 25 is connected with one first side wall 12. A resilient lock piece 13 and two restrictions 17 are formed unitarily on the first side wall 12 substantially opposite to the hinge 25.

A substantially plate-like base plate 14 projects from the extending end edge of the first side wall 12 in substantially the same direction as a standing direction of the first side wall 12, i.e. substantially in the same direction as a moving direction of the base plate 14 when the first piece 10 is closed with respect to the second piece 30. The resilient lock piece 13 is formed on an extending end of the base plate 14 and projects in a direction substantially opposite to an extending direction of the base plate 14 so that the resilient lock piece is spaced from and substantially parallel to the outer surface of the base plate 14. A lock projection 15 is formed at a longitudinal intermediate position of the outer surface of the resilient lock piece 13 and a wide operable portion 16 projects out at an extending end of the resilient lock piece 13. The resilient lock piece 13 normally is parallel with the base plate 14, but is resiliently deformable to an unlocking posture closer to the base plate 14 about the end of the resilient lock piece 13 that is connected with the extending end of the base plate 14.

The restrictions 17 extend along the opposite lateral edges of the base plate 14 substantially in the extending direction of the base plate 14. The restrictions 17 include plate-like walls 18 projecting substantially parallel with a resiliently deforming direction of the resilient lock piece 13 and substantially at right angles to the base plate 14. The wall portions 18 extend continuously over the entire area of the base plate 14 from the extending end to the base end and over the outer surface of the first side wall 12. The walls 18 reinforce the base plate 14 to a higher rigidity. Therefore the base plate 14 will not deform into a curved shape and will not incline to become oblique to the first side wall 12.

This walls 18 project toward the outer sides of the base plate 14 and are at the opposite sides of the resilient lock piece 13. Accordingly, the restrictions 17, and specifically the walls 18, protect the resilient lock piece 13 from interference by external matter. A formation area of the walls 18 in the extending direction of the resilient lock piece 13 corresponds to an area of the resilient lock piece 13 excluding the operable portion 16.

Claws 19 project from the outer edges of the walls 18 at positions opposite to the base plate 14. The claws 19 are located between the lock projection 15 and the operable portion 16 with respect to the extending direction of the resilient lock piece 13 and are more outward than the outer surface of the resilient lock piece 13 in the resiliently deforming direction of the resilient lock piece 13. Further, the claws 19 projects substantially in the same direction as the extending direction of the base plate 14. Grooves 20 are formed between the claws 19 and the walls 18 and have openings that face a frame portion 33 of the second piece 30 when the first and second pieces 10, 30 are closed.

The second piece 30 includes a second bottom wall 31 and two second side walls 32 project up from the substantially opposite lateral edges of the second bottom wall 31. The hinge 25 is connected with one second side wall 32. The frame 33 is formed unitarily on the outer surface of the second side wall 32 substantially opposite to the hinge 25.

The frame 33 has two side frames 34 that project at substantially right angles from the outer surface of the second side wall 32, and a coupling 35 bridges the projecting ends of the side frames 34. A space enclosed by the second side wall 32, the side frames 34 and the coupling 35 defines an accommodation space penetrating substantially in a vertical direction.

The side frames 34 are substantially continuous from a base end to an extending upper end of the second side wall 32. Outer walls 37 bridge between the projecting end edges of the side frames 34 and the outer surface of the second side wall 32. Upper walls 38 bridge between the upper end edges of the side frames 34 and the second side wall 32. The outer walls 37 and the upper walls 38 are connected at substantially right angles to each other and reinforce the side frames 34 to have higher rigidities.

The coupling 35 is connected with the upper ends of the side frames 34. Further, ribs 39 project toward one another from end edges of the side frames 34 except parts connected with the coupling 35. A cutout 40 is defined between the ribs 39 and provides communication between the interior of the accommodation space 36 and the outside. A lock 41 is defined on an area of the coupling 35 between the ribs 39 and is engageable with the lock projection 15. Engaging portions 42 are defined where opposite ends of the coupling 35 and upper ends of the ribs 39 are connected at substantially right angles and are engageable with the claws 19 and the grooves 20 of the restrictions 17.

A terminal fitting (not shown) can be accommodated into the second piece 30 and then the first piece 10 is rotated onto the second piece 30 about the hinge 25 while the hinge portion 25 is deformed. As the assembling proceeds, the resilient lock piece 13 and the restrictions 17 obliquely approach the frame 33 and the extending end of the base plate 14 and the base end of the resilient lock piece 13 are inserted into the accommodation space 36 of the frame 33.

Figure 10:
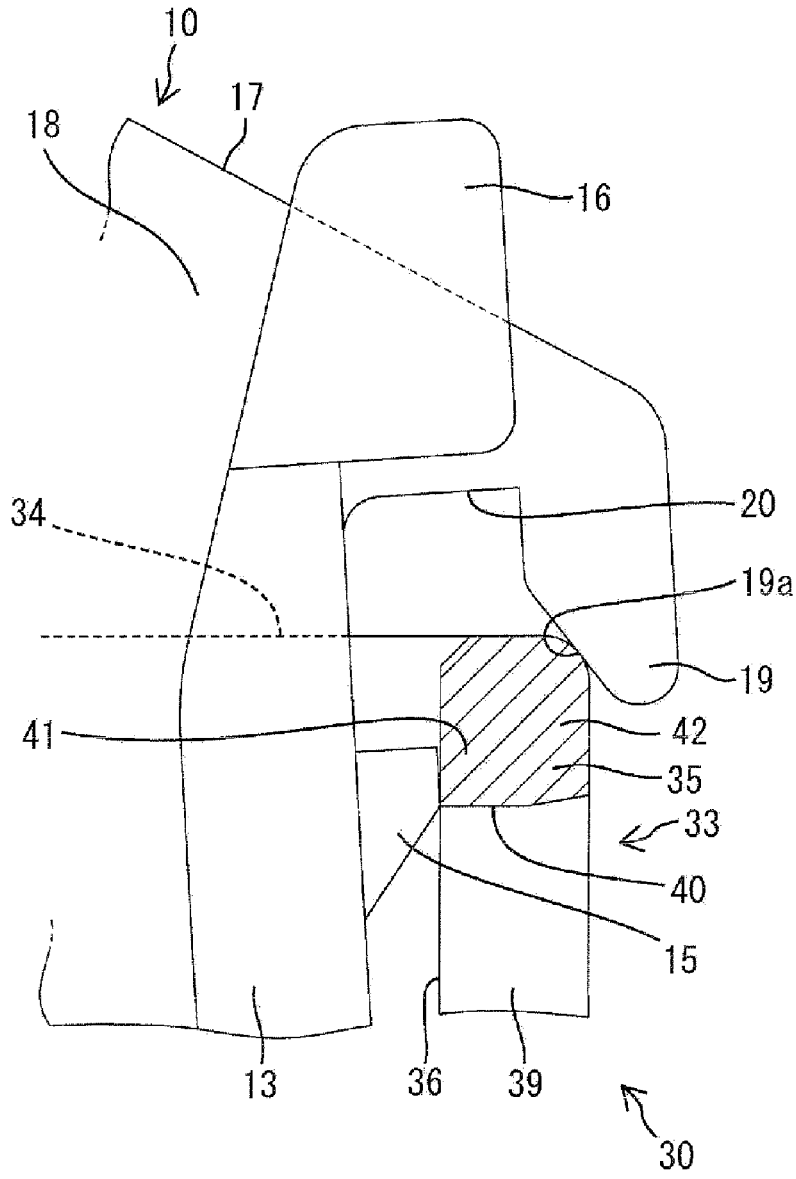
FIG. 10 is a partial enlarged side view partly in section showing an intermediate state while the first and second half pieces are being united.

The lock projection 15 contacts the lock 41 immediately before reaching a properly united state and, thereafter, the resilient lock 13 is deformed away from the lock 41 and the lock projection 15 slides into contact with the inner surface of the lock 41 (surface facing the accommodation space 36). Further, as shown in FIG. 10, inner slanted surfaces 19*a* of the claws 19 contact the engaging portions 42 with the lock projection 15 held in contact with the inner surface of the lock 41. Thereafter, the engaging portions 42 are guided into the grooves 20 by the inclinations of the slanted surfaces 19*a* and the resilient lock piece 13 is deformed more to reach the unlocking posture. The engagement of the claws 19 with the engaging portions 42 prevent the restricting portions 17 and the resilient lock pieces 13 from being separated from the coupling 35 and moving toward the outer surface of the second side wall 32 (displacing direction of the resilient lock piece 13 toward the unlocking posture).

Figure 11:
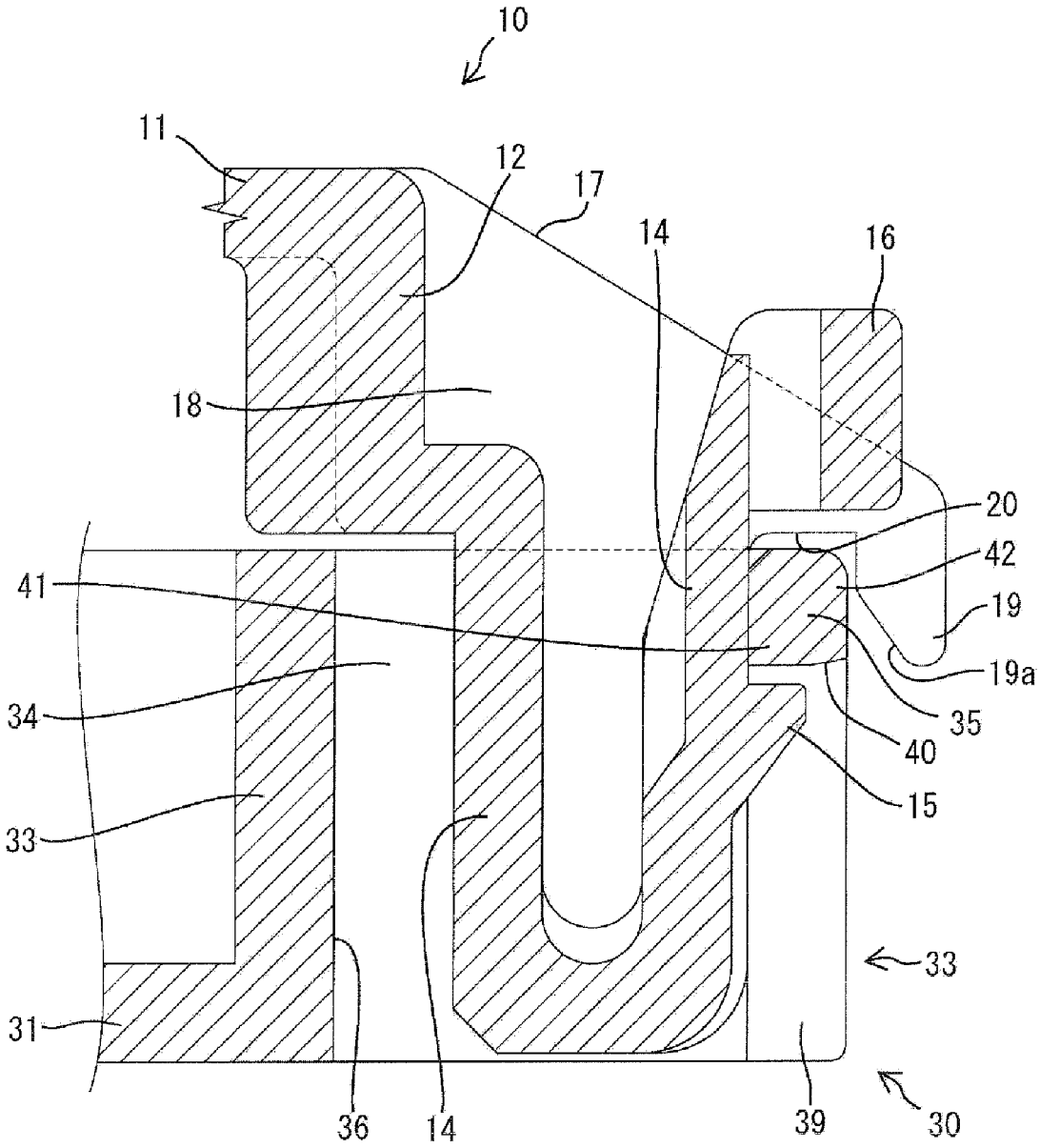
FIG. 11 is a partial enlarged section partly cut away showing the state where the first and second half pieces are united.

The lock projection 15 passes the lock 41 when the first piece 10 is assembled to the proper united state with the second piece 30. Therefore the resilient lock 13 restores resiliently to its locking posture and the lock projection 15 enters the cutout 40 to engage the lock portion 41 from below, as shown in FIG. 11. This engagement of the lock projection 15 and the lock 41 locks the first and second pieces 10, 30 in the united state. Further, the engagement of the claws 19 with the engaging portions 42 from the outer side prevents the restrictions 17 and the resilient lock piece 13 from moving in a direction to disengage the lock projection 15 from the lock 41. Thus, a locking function by the lock projection 15 and the lock 41 has high reliability and the first and second pieces 10, 30 are held reliably in the united state.

In the united state, most of the resilient lock piece 13, excluding the operable portion 16, is accommodated in the accommodation space 36. Additionally, the restrictions 17 and the side frames 34 are arranged doubly at the sides of the resilient lock 13. Further, the projecting end of the lock projection 15 is retracted inwardly from the projecting end edges of the side frames 34. Thus, the lock projection 15 is protected from interference of external matter. The operable portion 16 projects up from the side frames 34, and hence the resilient lock piece 13 can be deformed resiliently from the locking posture to the unlocking posture by pushing the operable portion 16.

As described above, the restrictions 17 for restricting displacements of the first and second pieces 10, 30 in the resiliently deforming direction of the resilient lock piece 13 are formed on the first piece 10 where the resilient lock piece 13 is formed. Thus, the restrictions 17 do not project from the second piece 30. Therefore, the shape of the second piece 30 is simple as compared with the case where the restrictions 17 are formed on the second piece 30.

Further, the grooves 20 of the restrictions 17 are engaged with the engaging portions 42 of the second piece 30 to fix the engaging portions 42 in a direction substantially parallel to the resilient deforming direction of the resilient lock piece 13. Thus, displacements of the first and second pieces 10, 30 are restricted in both directions substantially parallel to and opposite to the resilient deforming direction of the resilient lock piece 13.

The restrictions 17 include the plate-like walls 18 extending substantially parallel to the resilient deforming direction of the resilient lock 13 from the first piece 10. Thus, rigidity against external forces acting substantially parallel to the resilient deforming direction of the resilient lock 13 is high. Accordingly, displacements of the two pieces 10, 30 resulting from a resilient restoring force of the resilient lock 13 are restricted. In addition, the walls 18 are provided at the opposite sides of the resilient lock 13 to prevent external matter from interfering with the resilient lock 13.

The first piece 10 has the base plate 14 extending substantially in the uniting direction with the second piece 30 and the resilient lock 13 extends along the outer surface of the base plate 14 from the extending end of the base plate 14 in the direction substantially opposite to the extending direction of the base plate 14. Thus, the base plate 14 and the resilient lock 13 are cantilevered on the first piece 10 and could be deformed by external matter. However, the frame 33 on the outer surface of the second piece 30 accommodates the base plate 14 and the resilient lock piece 13 in the united state of the first and second pieces 10, 30. Therefore the base plate 14 and the resilient lock 13 are protected from interference of external matter.

A part of the frame 33 serves as the lock 41 that engages the resilient lock piece 13. Thus, the shape of the second piece 30 is simplified as compared with the case where the lock 41 is formed at a position different from at the frame 33 in the second piece 30.

Parts of the frame 33 define the engaging portions 42 to be engaged with the restrictions 17. Thus, the shape of the second piece 30 is simplified as compared with the case where the engaging portions 42 are at positions different from at the frame 33 of the second piece 30.

The base plate 14 has a cantilevered shaped and may be deformed. However, the restrictions 17 project along the lateral edges of the base plate 14 to reinforce the base plate 14 and to prevent deformation.

Further, the restrictions 17 project out at opposite sides of the resilient lock 13. Thus, the resilient lock piece 13 is protected from interference of external matter even when the resilient lock piece 13 is at an outer side of the frame 33 without the two half pieces 10, 30 being united.

The invention is not limited to the above described and illustrated embodiment. For example, the following embodiments are also embraced by the technical scope of the present invention as defined by the claims.

The restrictions may contact the second piece in substantially the same direction as the resiliently deforming direction of the resilient lock or in the direction opposite to the resiliently deforming direction of the resilient lock.

The restrictions may not include the plate-like walls, for example, by having such narrow and long claw-like shapes projecting from the first piece.

The wall may be formed only at one side of the resilient lock.

The restrictions may be at positions distant from the resilient lock.

The extending direction of the resilient lock may be substantially the same direction as the uniting direction of the first piece with the second piece.

The restrictions may be at positions of the base plate other than at the lateral edges and can be engaged at positions other than at the frame.

The restrictions formed on the lateral edges of the base plate may project inwardly toward a side opposite to the resilient lock.

The base plate may be reinforced by projections other than the restrictions.

The two restrictions may be coupled to each other.

The first and second pieces need not be halves of an overall tubular shape, and the tubular shape can be subdivided in any two pieces, e.g. the first piece may be a lid and the second piece may be channel (e.g. U-, V-shaped or have an open polygonal or rounded shape).

The hinge may be formed by engaging, two elements such as a bearing and a coupling, that allow pivotal movement of the first and second pieces into a substantially tubular shape.

What is claimed is:

1. A terminal cover, comprising:

a first piece;

a second piece hingedly coupled to the first piece, the first and second pieces being configured to define a substantially tubular shape by hingedly rotating at least one of the first and second pieces into a united state;

at least one resilient lock piece projecting from the first piece and being resiliently deformable in a direction intersecting a uniting direction of the first piece with the second piece;

at least one lock formed on the second piece and being engageable with the lock piece to lock the first and second pieces in the united state; and at least one restriction projecting from the first piece and being configured for restricting displacements of the first and second pieces in a resiliently deforming direction of the resilient lock piece, the restriction including at least one groove engageable with the second piece and fixing the second piece in a direction substantially parallel to the resilient deforming direction of the resilient lock piece.

2. The terminal cover claim 1, further comprising a deformable hinge coupling the first and second pieces and enabling the first and second pieces to be rotated into the substantially tubular shape.

3. The terminal cover of claim 1, wherein the restriction includes at least one wall projecting from the first piece substantially parallel to the resilient deforming direction of the resilient lock piece.

4. The terminal cover of claim 3, wherein two walls are provided respectively at opposite sides of the resilient lock piece.

5. A terminal cover, comprising:

first and second pieces hingedly coupled to one another and being configured to define a substantially tubular shape by hingedly rotating at least one of the first and second pieces into a united state, the first piece having a base plate extending substantially in a uniting direction with the second piece;

at least one resilient lock piece projecting from the first piece and being resiliently deformable in a direction intersecting the uniting direction of the first piece with the second piece, the resilient lock piece extending along an outer surface of the base plate from an extending end of the base plate in a direction opposite to an extending direction of the base plate (14);

at least one lock formed on the second piece and being engageable with the lock piece to lock the first and second pieces in the united state; and two restrictions projecting from the first piece along lateral edges of the base plate at opposite sides of the resilient lock piece and being configured for restricting displacements of the first and second pieces in a resiliently deforming direction of the resilient lock piece;

at least one frame is formed on an outer surface of the second piece in the united state for at least partly accommodating the base plate and the resilient lock piece, the lock being defined on part of the frame; and an engaging portion on a part of the frame and being engageable with the restriction in the united state.

* * * * *